US006691616B2

(12) United States Patent
Wolf

(10) Patent No.: US 6,691,616 B2
(45) Date of Patent: Feb. 17, 2004

(54) DEVICE FOR DETECTING THE POSITION OF A PRINTING PLATE ON A CYLINDER OF A ROTARY PRINTING MACHINE

(75) Inventor: Thomas Wolf, Karlsruhe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/093,232

(22) Filed: Mar. 7, 2002

(65) Prior Publication Data

US 2002/0112634 A1 Aug. 22, 2002

Related U.S. Application Data

(63) Continuation-in-part of application No. 09/566,934, filed on May 8, 2000, now abandoned.

(30) Foreign Application Priority Data

May 7, 1999 (DE) ..... 199 21 272

(51) Int. Cl.[7] ..... B41F 27/12
(52) U.S. Cl. ..... 101/415.1; 101/486; 101/477
(58) Field of Search ..... 101/415.1, 477, 101/481, 484, 485, 486, DIG. 36

(56) References Cited

U.S. PATENT DOCUMENTS

| | | | | | |
|---|---|---|---|---|---|
| 4,257,324 | A | | 3/1981 | Stefansson et al. | |
| 4,437,407 | A | * | 3/1984 | Wirz et al. | 101/409 |
| 4,603,641 | A | | 8/1986 | Jeschke et al. | |
| 5,320,041 | A | | 6/1994 | Maejima et al. | |
| 5,461,980 | A | | 10/1995 | Maejima et al. | |
| 5,479,859 | A | * | 1/1996 | Lindner et al. | 101/485 |
| 5,486,063 | A | * | 1/1996 | Fox et al. | 400/708 |
| 5,664,495 | A | | 9/1997 | Winter | |
| 5,746,122 | A | | 5/1998 | Gietz et al. | |
| 5,978,004 | A | * | 11/1999 | Ehrhardt | 347/171 |
| 6,032,581 | A | * | 3/2000 | Beutler et al. | 101/477 |
| 6,101,938 | A | | 8/2000 | Adams | |
| 6,135,027 | A | | 10/2000 | Rudzewitz et al. | |
| 6,361,043 | B1 | * | 3/2002 | Hutchison | 271/263 |
| 6,481,349 | B2 | * | 11/2002 | Jehring et al. | 101/415.1 |

FOREIGN PATENT DOCUMENTS

| | | |
|---|---|---|
| DE | 34 38 931 C2 | 4/1986 |
| DE | 38 14 054 C2 | 11/1989 |
| DE | 94 18 049.0 U1 | 2/1995 |
| DE | 196 07 297 C2 | 10/1997 |
| DE | 298 15 443 U1 | 1/1999 |
| EP | 0 551 976 A1 | 7/1993 |

* cited by examiner

*Primary Examiner*—Leslie J. Evanisko
(74) *Attorney, Agent, or Firm*—Laurence A. Greenberg; Werner H. Stemer; Ralph E. Locher

(57) ABSTRACT

A device for detecting the position of a printing plate on the plate cylinder of a printing machine has register equipment corresponding with an edge of the printing plate. The device includes at least one mechanical stress sensor assigned to the register equipment. The at least one mechanical stress sensor is a piezoelectric force sensor.

11 Claims, 6 Drawing Sheets

DEVICE FOR DETECTING THE POSITION OF A PRINTING PLATE ON A CYLINDER OF A ROTARY PRINTING MACHINE

CROSS-REFERENCE TO RELATED APPLICATION

This application is a continuation-in-part of U.S. application Ser. No. 09/566,934, filed May 8, 2000 now abandoned.

BACKGROUND OF THE INVENTION

Field of the Invention

The invention relates to a device for detecting the position of a printing plate on a cylinder of a rotary printing machine.

In order to check the accurate in-register set-up of printing plates, it is generally known to use an electric circuit that is closable by the engagement of register pins of the clamping or locking bar in dimension notches on the printing plate.

For example, in the published European Patent Document EP 0 551 976 B1, there are provided electrically conductive stops for a printing plate, an electric circuit being closed by the electrically conductive printing plate when an accurate set-up or contact exists between the printing plate and the stops and, in this manner, precise positioning of the printing plate is indicated.

SUMMARY OF THE INVENTION

It is accordingly an object of the invention to provide a device for detecting a printing-plate position which operates without electrically conductive stops.

With the foregoing and other objects in view, there is provided, in accordance with the invention, a device for detecting the position of a printing plate on a plate cylinder of a printing machine, comprising:

register equipment corresponding with an edge of the printing is plate, the register equipment being made up of one of stops formed of pins and bolts; and at least one mechanical stress sensor assigned to the register equipment, the at least one stress sensor being a piezoelectric force sensor, and the at least one stress sensor being disposed one of in and in an immediate vicinity of the one of stops and bolts.

In accordance with another feature of the invention, the at least one stress sensor and the one of stops and bolts are applied to a clamping bar.

In accordance with a further feature of the invention, one of the one of stops and bolts has a circular cross section and is assigned two stress sensors.

In accordance with an added feature of the invention, the stress sensors are disposed at an angle to one another. The angle is about 30–150°, and preferably about 45°.

In accordance with an additional feature of the invention, one of the one of stops and bolts has a rectangular cross and is assigned one stress sensor.

In accordance with yet another feature of the invention, apertures and webs are formed in a region around the register equipment.

In accordance with yet a further feature of the invention, the at least one stress sensor is arranged on the webs.

In accordance with yet an added feature of the invention, the detecting device further comprises a first inductive transmitter disposed on the plate cylinder and a second inductive transmitter fixed to a machine frame. The first inductive transmitter is opposite to the second inductive transmitter for transferring data during feeding of the printing plate onto the printing cylinder.

In accordance with yet an additional feature of the invention, the detecting device further comprises at least one indicator disposed on the clamping bar.

In accordance with still another feature of the invention, the detecting device further comprises an energy source disposed on the clamping bar.

Thus, mechanical stress sensors are advantageously used as printing-plate detecting equipment.

Each piece of register equipment, which corresponds to an edge of the printing plate, has at least one mechanical stress sensor assigned thereto. The mechanical stress sensors are arranged in the region of lines of force action which are produced when a piece of register equipment experiences mechanical deformation or deflection. The mechanical stress sensors are preferably arranged in or in the vicinity of the register equipment, for example, stops, because the stresses introduced thereat are at their greatest and thus can be detected most accurately.

Particularly advantageous is an arrangement of the mechanical stress sensors in the base of the clamping bar in which the register equipment is arranged.

In an advantageous development, provision is made for weakening the region around the register equipment by forming apertures or recesses, so that the register equipment is deflected even under the action of extremely small forces. In this regard, the mechanical stress sensors can be arranged on webs which are provided between the apertures.

In an embodiment according to the invention, the mechanical stress sensors comprise piezoceramic structure-borne sound or audio sensors. Piezoceramic structure-borne sound sensors offer an advantage in that they react primarily to dynamic changes or states, such as the insertion of a plate. Slow stress changes, such as aging of the machine, distortion of mechanical components and the like are in this case not detected.

Other features which are considered as characteristic for the invention are set forth in the appended claims. Although the invention is illustrated and described herein as embodied in a device for detecting the position of a printing plate on a cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
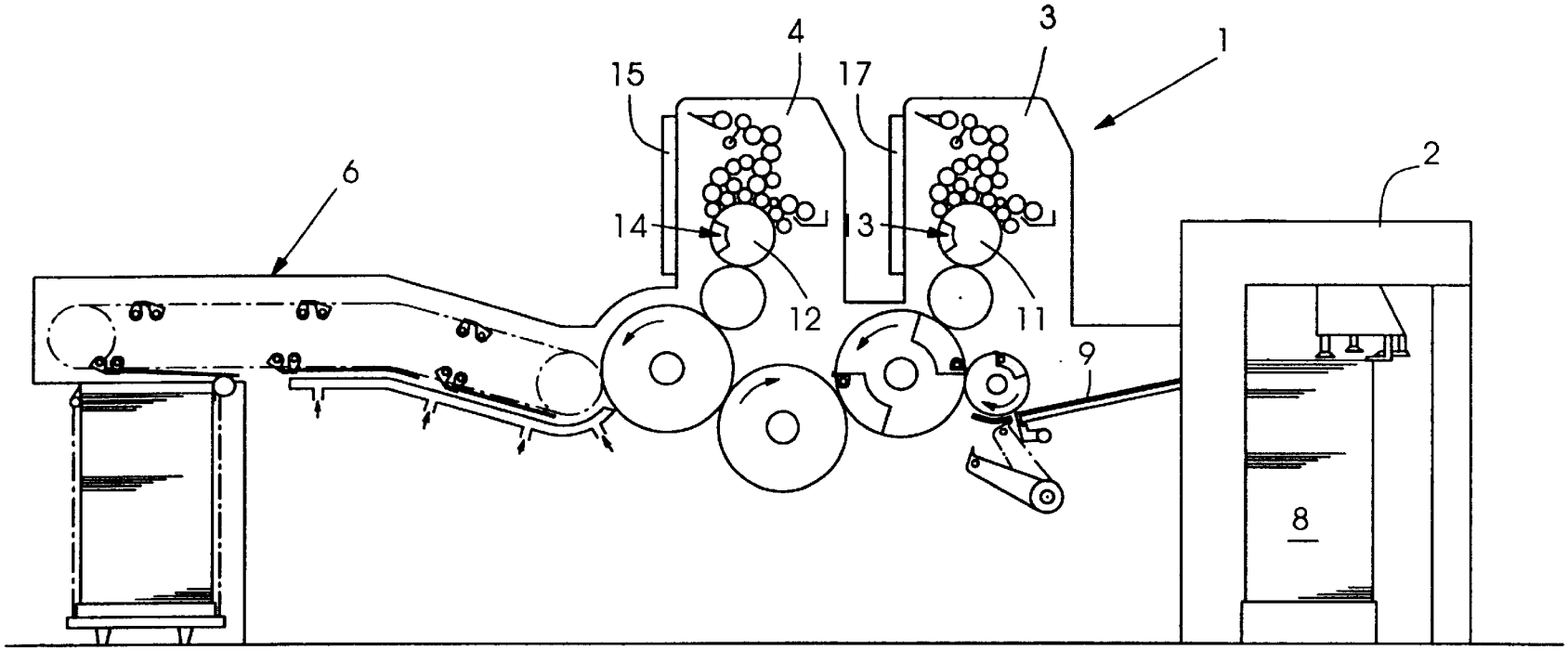
FIG. 1 is a diagrammatic side elevational view of a sheet-fed rotary printing machine incorporating the position-detecting device according to the invention.
Figure 2:
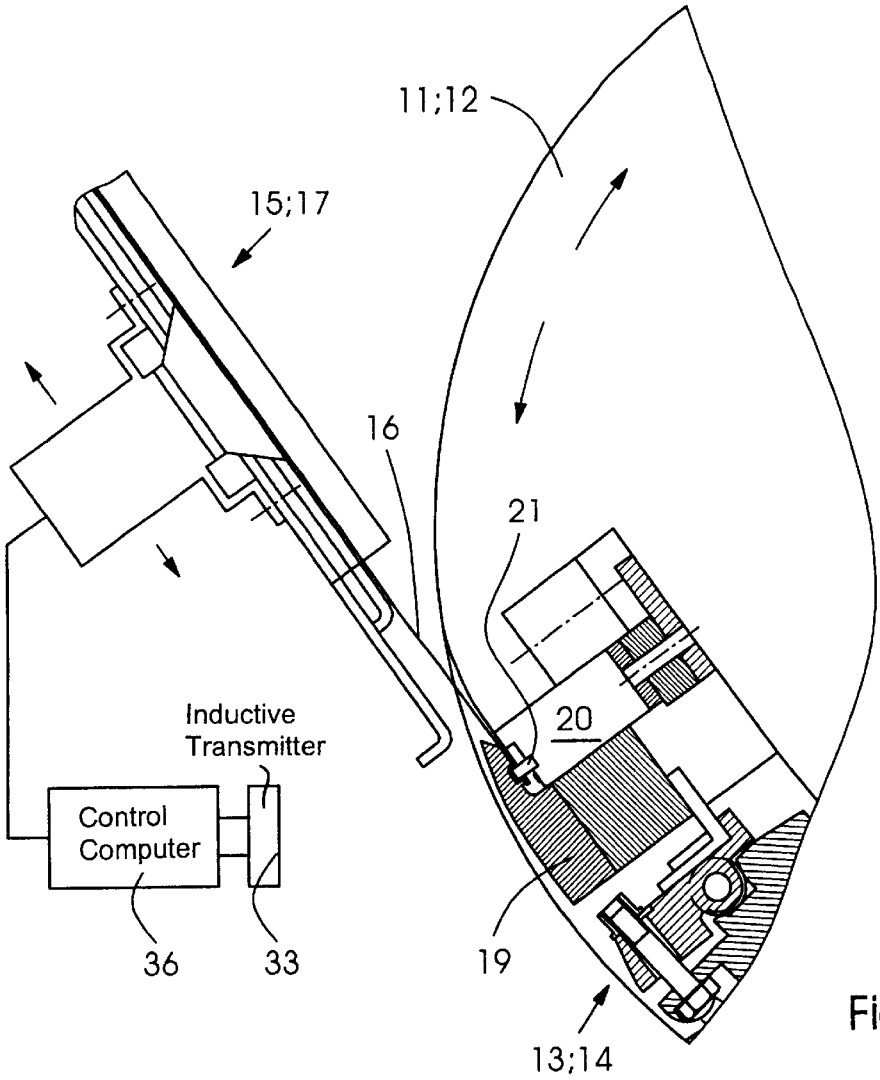
FIG. 2 is a fragmentary side elevational view, partly in section, of a plate cylinder in a printing-plate feeding position.

Referring now to the drawings and, first, particularly to FIG. 1 thereof, there is shown therein a rotary printing machine, for example, a sheet-processing printing machine 1, having a feeder 2, at least one printing unit 3 and 4 and a delivery 6. Sheets are taken from a sheet pile 8 and fed, separately, i.e., singly, or overlappingly, i.e., in a sheet stream, over a feed table 9 to the printing units 3 and 4. Each of the printing units 3 and 4 conventionally has a respective plate cylinder 11, 12, each of which, in turn, having a respective device 13, 14 for affixing flexible printing plates 16 to the respective plate cylinder 11, 12. Furthermore, to each plate cylinder 11, 12 there is assigned a respective device 15, 17 for semi-automatically or fully automatically changing the printing-plate.

Figure 3:
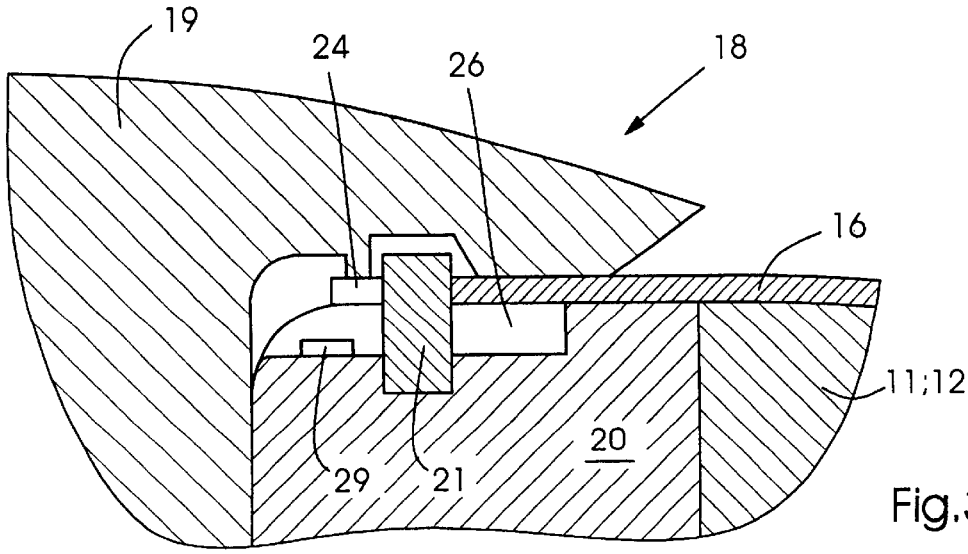
FIG. 3 is a fragmentary sectional view of FIG. 2, rotated through an angle of about 60° clockwise, showing a holding region of a clamping or locking bar on the plate cylinder.
Figure 4:
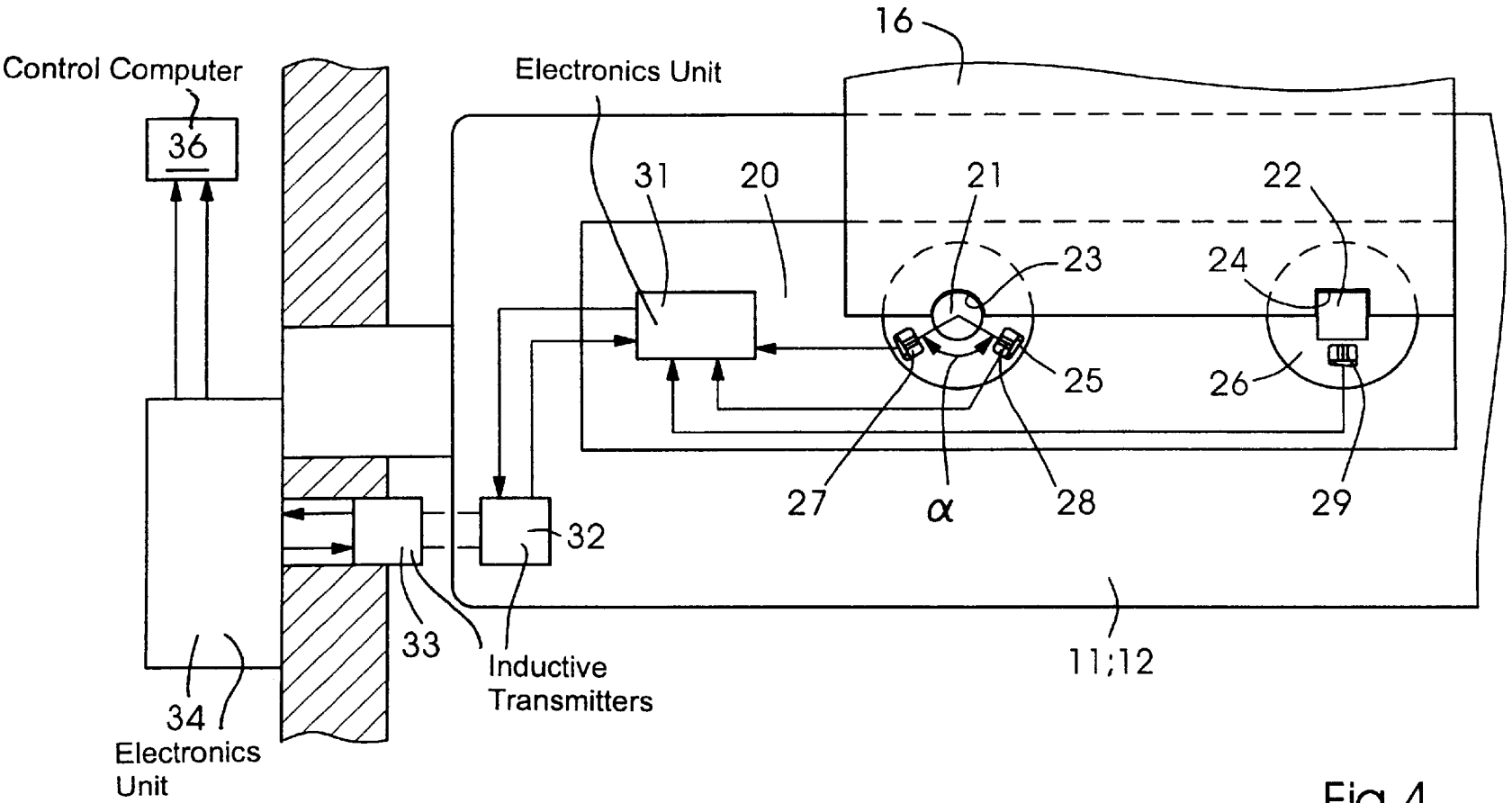
FIG. 4 is a diagrammatic and schematic plan view of FIG. 3, with the clamping or locking bar removed, showing mechanical stress sensors in accordance with the invention.

In the exemplary embodiment shown in FIG. 3, the device 13, 14 for affixing a flexible printing plate 16 includes a respective clamping or locking bar 18 made up of a fixed upper clamping strip 19 and a movable lower clamping strip 20. In the exemplary embodiment of FIG. 4, in a holding region for a printing plate 16, formed by the clamping strips 19 and 20, there are provided stops 21 and 22, which cooperate with the leading edge of the printing plate or with stamped or punched-out portions 23 and 24 formed on the leading edge of the printing plate. The stops 21 and 22 can be arranged opposite the lower clamping strip 20, so that they can be adjusted axially or in circumferential direction.

The stops 21 and 22 are accommodated in a recess 25, 26 formed in the lower clamping strip 20. Also arranged in the recesses 25 and 26 are mechanical stress sensors 27, 28 or 29, preferably piezoelectric force sensors for measuring forces and mechanical stresses. Piezoelectric force sensors are particularly well suited therefor, because they measure dynamically, which means that the measurement signal is again dissipated after the measurement operation. The sensors 27, 28 or 29 are preferably applied in such a manner that, as viewed from the register device, i.e., the stop 21, 22, they are arranged on the side lying opposite to the printing plate 16.

To be able to detect the extent of any misalignment of the printing plate 16 with the stops 21 and 22, the sensors 27 and 28 of the stop 21, which has a circular cross section, are arranged at an angle $\alpha$ (e.g. $\alpha$=30° to 150°), preferably 45°, to one another, in relation to the stop 21. With this arrangement, a nonuniform pressure distribution and, therefore, a canting or on-edge disposition of the printing plate 16 can be registered. The third sensor 29 is assigned to the stop 22, which has a rectangular cross section.

The sensors 27, 28 and 29 are connected by electric lines to a first electronics unit 31, which is arranged on the plate cylinder 11, in particular on the clamping or locking bar 20.

In order to transmit the data picked up by the sensors 27, 28 and 29, a first inductive transmitter 32 is provided at the end of the plate cylinder 11 and, during the feeding and during the clamping operation of the leading edge of the printing plate 16, is located opposite a second inductive transmitter 33 that is fixed to the machine frame. The second inductive transmitter 33 conducts the data received from the first inductive transmitter 32 to a second electronics unit 34, which is connected to a control computer 36 of the printing machine in order to evaluate the data.

Figure 6:
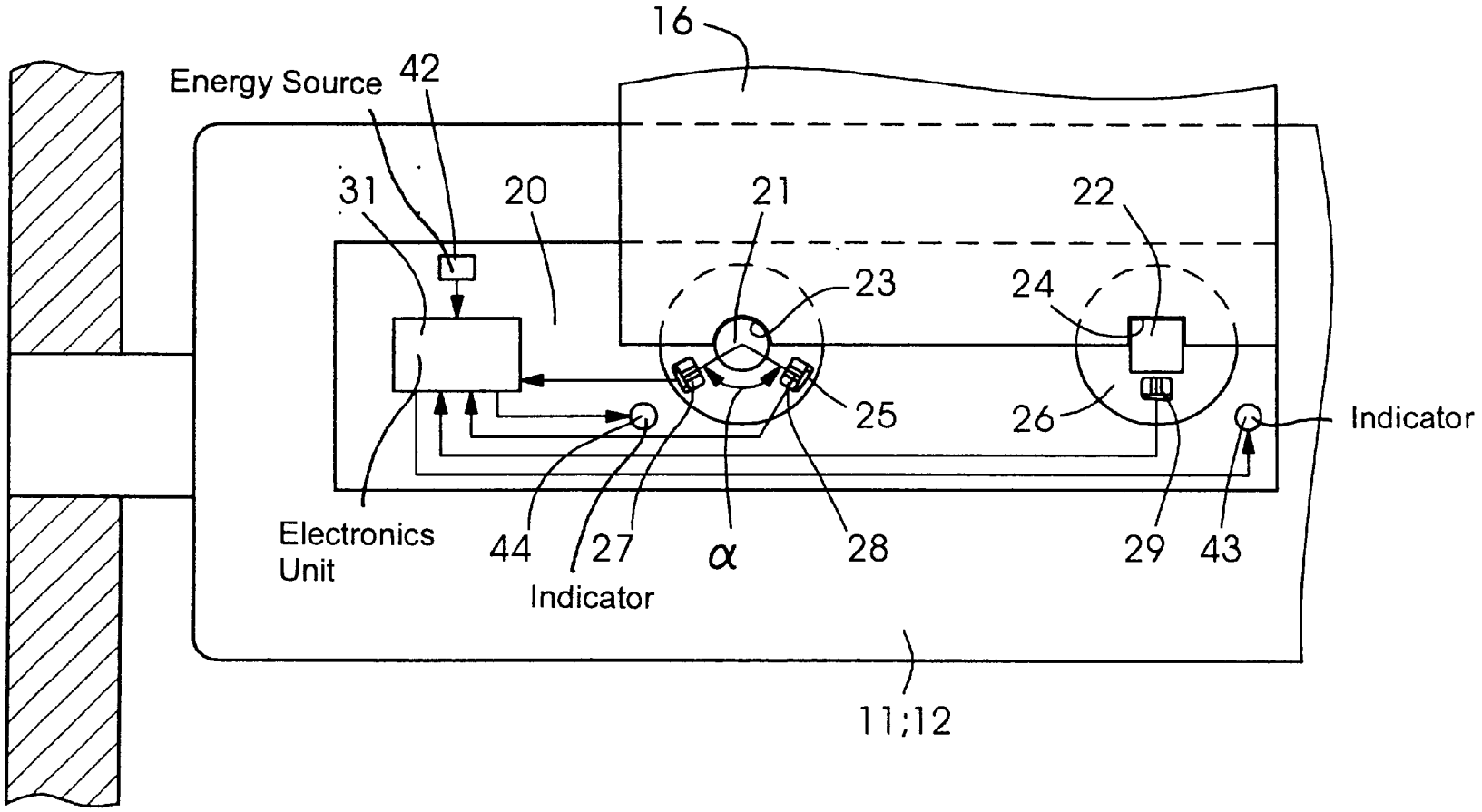
FIG. 6 is a further exemplary embodiment of the arrangement of mechanical stress sensors according to FIG. 4 or 5, wherein the indicator and the energy supply are arranged on a clamping or locking bar.

In an alternative construction shown in FIG. 6, quite opposed to the inductive transmission of data and energy, an energy supply source 42 is arranged directly on the clamping bar 20 and is connected to the electronics unit 31. In this case, the energy supply source 42 can be, for example, a battery, an accumulator or a dynamo in connection with a chargeable accumulator, wherein the feed of energy is taken from the rotation of the plate cylinder 11, 12. In this regard, the register stops 21 and 22 have a respective indicator 43, 44, preferably an LED indicator, assigned thereto.

A printing plate 16 fed to the plate cylinder 11 by the printing-plate feeding device 15, 17 rests on the stops 21 and 22 essentially under its own weight and, as a result, effects a small deformation on the support or fixing location on the stops 21 and 22 at the bottom of the recesses 25 and 26, respectively. The mechanical stress sensors 27, 28 and 29 are applied to the lines of force action produced by mechanical stresses thereby.

Figure 5:
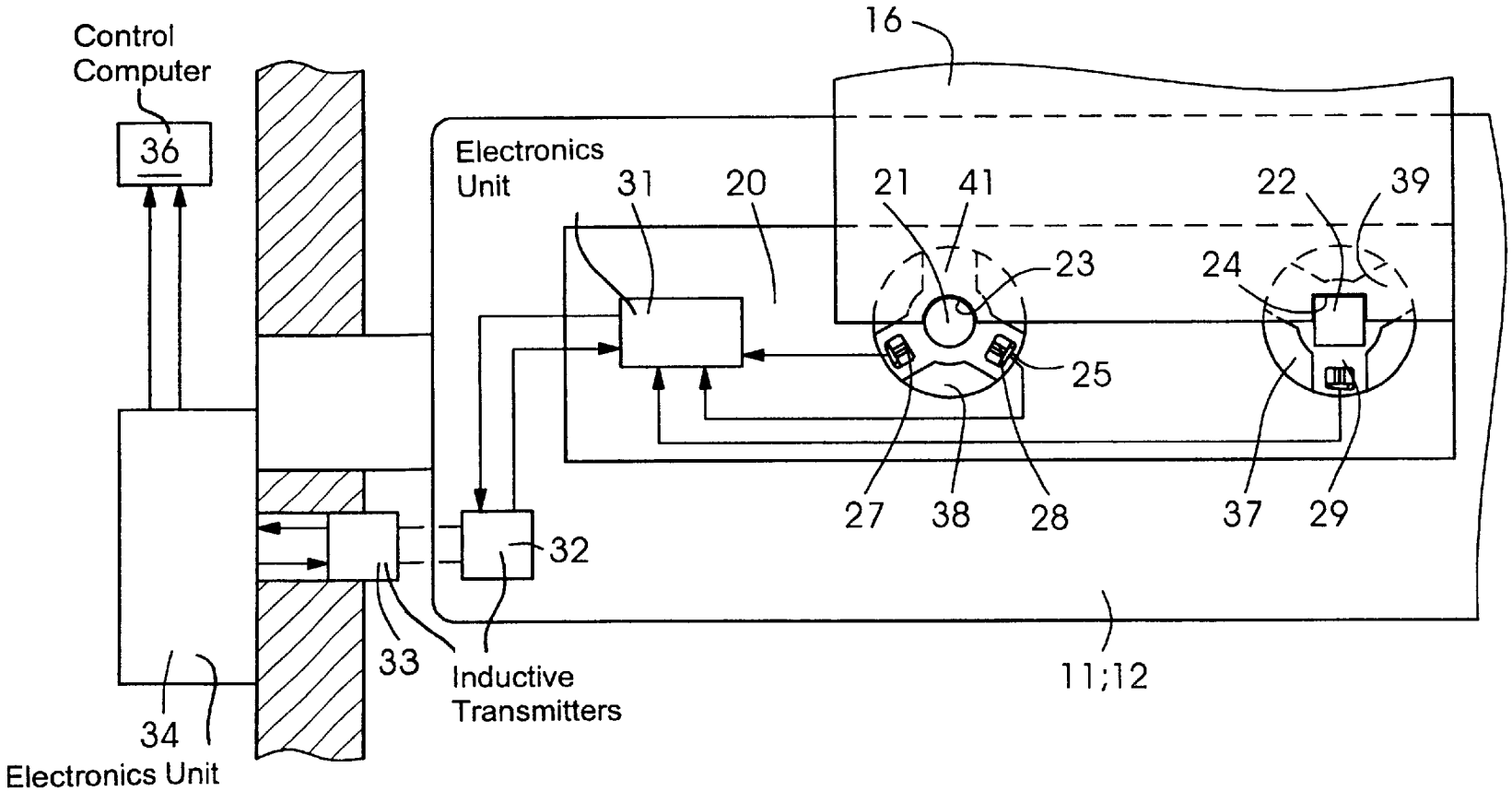
FIG. 5 is a view like that of FIG. 4 of another exemplary embodiment of the arrangement of mechanical stress sensors.

In order to reinforce the lines of force action, as shown in FIG. 5, apertures 37 and 38 are provided in the region around the stops 21 and 22, and the sensors 27, 28 and 29 are arranged on webs 39 to 41. Thereby, when the stops 21 and 22 are loaded by the printing plate 16, very high mechanical stresses are produced in the webs 39 and 41, and thus a very stronger evaluatable signal is produced at the electronics unit 31.

Figure 7:
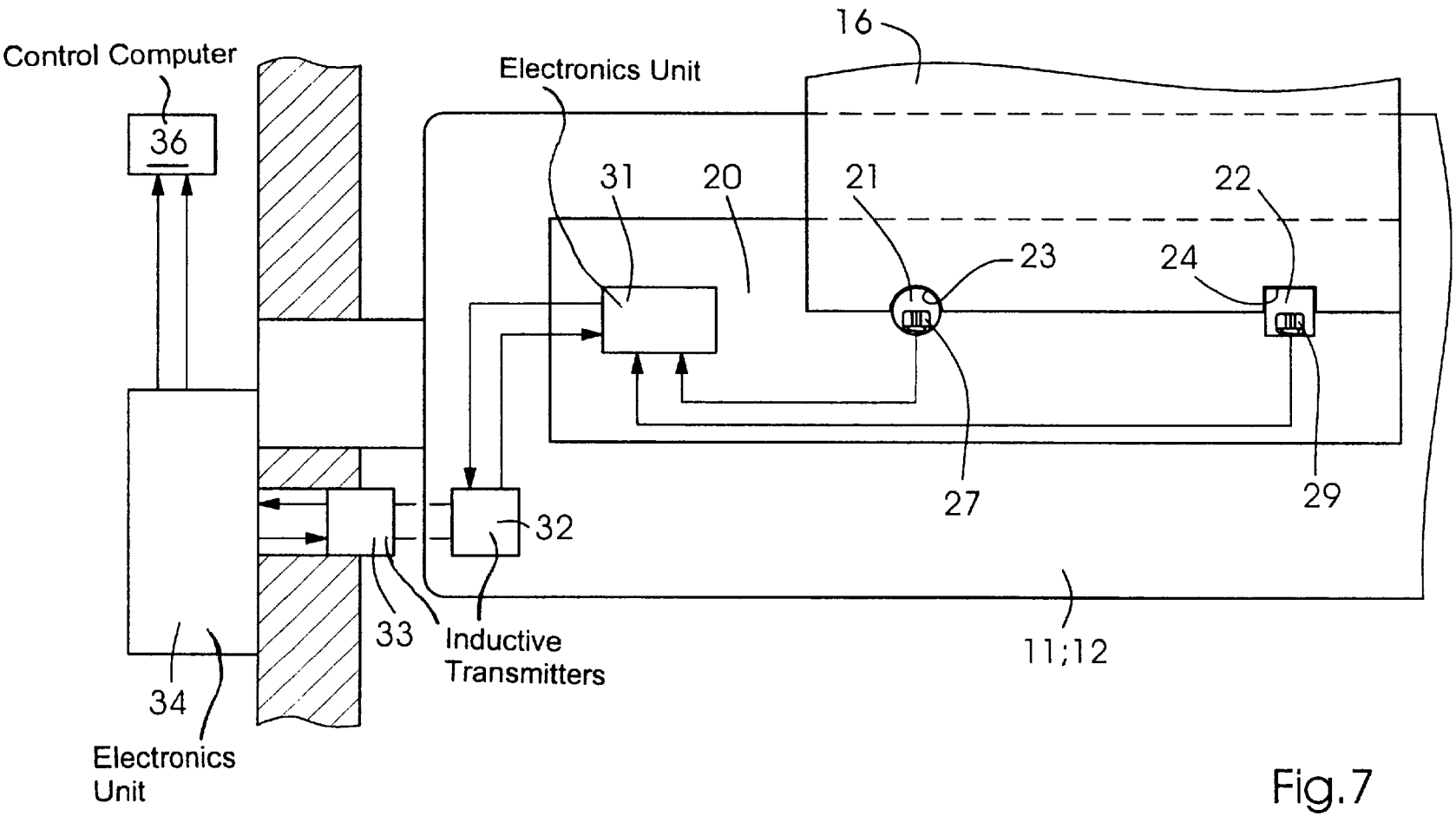
FIG. 7 is a view like that of FIG. 4 of a further exemplary embodiment of the arrangement of mechanical stress sensors.

In an alternative construction shown in FIG. 7, the sensors 27 and 29 are arranged in the respective stops 21 and 22.

I claim:

1. A device for detecting the position of a printing plate on a plate cylinder of a printing machine, comprising:

a clamping bar for holding the printing plate;

register equipment corresponding with an edge of the printing plate, said register equipment being made up of stops formed as pins or bolts;

at least one mechanical stress sensor assigned to said register equipment, said at least one stress sensor being a piezoelectric force sensor, and said at least one stress sensor being disposed one of in and in an immediate vicinity of said stops;

at least one stress sensor and said stops being applied to said clamping bar and wherein said at least one stress sensor measures stresses caused by deformation of said register equipment when the edge of the printing plate is brought into engagement with said register equipment.

2. The detecting device according to claim 1, wherein one of said stops has a circular cross section and is assigned two stress sensors.

3. The detecting device according to claim 2, wherein said stress sensors are disposed at an angle to one another.

4. The detecting device according to claims 3, wherein said angle is between about 30–150°.

5. The detecting device according to claim 3, wherein said angle is about 45°.

6. The detecting device according to claim 1, wherein one of said stops has a rectangular cross and is assigned one stress sensor.

7. The detecting device according to claim 1, wherein apertures and webs are formed in a region around said register equipment.

8. The detecting device as claimed in claim 7, wherein said at least one stress sensor is arranged on said webs.

9. The detecting device according to claim 1, further comprising a first inductive transmitter adapted to be disposed on the plate cylinder and a second inductive transmitter adapted to be fixed to a machine frame, said first inductive transmitter being opposite to said second inductive transmitter for transferring data during feeding of the printing plate onto the printing cylinder.

10. The detecting device according to claim 1, further comprising at least one indicator disposed on said clamping bar.

11. The detecting device according to claim 1, further comprising an energy source disposed on said clamping bar.

* * * * *